United States Patent [19]

Martinez

[11] Patent Number: 4,659,457

[45] Date of Patent: Apr. 21, 1987

[54] GRAVITY-MAGNETIC ORE SEPARATORS AND METHODS

[76] Inventor: Edward Martinez, 1 Alpine Ct., Huntington Ct., Belle Mead, N.J. 08502

[21] Appl. No.: 781,953

[22] Filed: Sep. 30, 1985

Related U.S. Application Data

[62] Division of Ser. No. 482,040, Apr. 4, 1983, Pat. No. 4,565,624.

[51] Int. Cl.[4] ..... B03C 1/06

[52] U.S. Cl. ..... 209/40; 209/217; 209/218; 209/227; 209/228; 209/478; 209/441; 209/459; 209/233 R

[58] Field of Search ..... 209/40, 478, 131, 218, 209/226, 227, 217, 228, 232 R, 441, 459

[56] References Cited

U.S. PATENT DOCUMENTS

| | | | |
|---|---|---|---|
| 109,354 | 11/1870 | Smith . | |
| 359,085 | 3/1887 | Mansfield . | |
| 453,317 | 6/1891 | Townsend . | |
| 581,032 | 4/1897 | Pike | 209/478 |
| 855,166 | 5/1907 | Edwards | 209/227 |
| 1,066,619 | 7/1913 | Isbell . | |
| 1,157,543 | 10/1915 | Jobke . | |
| 1,463,713 | 7/1923 | Mordey . | |
| 2,087,092 | 7/1937 | Lynch | 209/441 |
| 2,287,115 | 6/1942 | McCluskey | 209/441 |
| 2,291,042 | 7/1942 | Kennedy . | |
| 2,372,321 | 3/1945 | Griffiths . | |
| 2,478,934 | 8/1949 | Morse . | |
| 2,582,302 | 1/1952 | Weber | 209/441 |
| 2,644,583 | 7/1953 | Cannon et al. . | |
| 3,033,369 | 5/1962 | Kragle | 209/223.1 |
| 3,720,312 | 3/1973 | Shook et al. . | |
| 3,966,590 | 6/1976 | Boom et al. . | |
| 4,354,930 | 10/1982 | Nakajima . | |
| 4,563,279 | 1/1986 | Wright | 209/459 |

FOREIGN PATENT DOCUMENTS

| | | | |
|---|---|---|---|
| 54-143967 | 9/1979 | Japan . | |
| 5039 | of 1897 | United Kingdom . | |
| 426860 | 4/1935 | United Kingdom . | |
| 563333 | 8/1944 | United Kingdom . | |
| 589558 | 6/1947 | United Kingdom . | |
| 748855 | 5/1956 | United Kingdom . | |
| 768605 | 2/1957 | United Kingdom . | |
| 859516 | 1/1961 | United Kingdom . | |
| 1061654 | 3/1967 | United Kingdom . | |
| 1175318 | 12/1969 | United Kingdom . | |
| 1190203 | 4/1970 | United Kingdom . | |
| 543412 | 3/1977 | U.S.S.R. | 209/40 |
| 628951 | 10/1978 | U.S.S.R. . | |
| 0782869 | 11/1980 | U.S.S.R. . | |
| 973166 | 11/1982 | U.S.S.R. | 209/223 R |

OTHER PUBLICATIONS

A. F. Taggart, Elements of Ore Dressing, John Wiley, New York, (1951), pp. 44–45, 53–57.

Y. M. Eyssa et al., "Flow Through Magnetic Separators for Weakly-Magnetic Ores Designed for Superconducting Magnets", IEEE Transactions on Magnetics, vol. Mag-11, No. 5, Sep. 1975, pp. 1585–1587.

Edward Martinez, "The Concentration of Weakly Magnetic Minerals", The Pennsylvania State College, Department of Mineral Engineering, Masters Thesis, 1953, pp. 5–11.

A. F. Taggart, Handbook of Mineral Dressing, John Wiley, New York, 1945, pp. 13–20.

R. S. Dean and C. W. Davis, Magnetic Separation of Ores, Bulletin 425, U.S. Dept. of Interior, 1939, pp. 208, 210.

*Primary Examiner*—Tim Miles

*Attorney, Agent, or Firm*—Stiefel, Gross, Kurland & Pavane

[57] ABSTRACT

A gravity-magnetic ore separator for concentrating magnetic or weakly magnetic minerals having a relatively high specific gravity is disclosed. The ore separator utilizes codirectional magnetic and gravitational forces to achieve separation capabilities in excess of that which can be achieved using gravity forces alone. Typically, the gravity-magnetic ore separator is formed by retrofitting a conventional gravity separator such as a spiral, cone, pinched sluice, etc. with magnets so as to enhance the separation capability of the conventional gravitational ore separator. Means are provided to prevent build up of magnetic material on the surface over which the ore flows.

10 Claims, 6 Drawing Figures

FIG.4
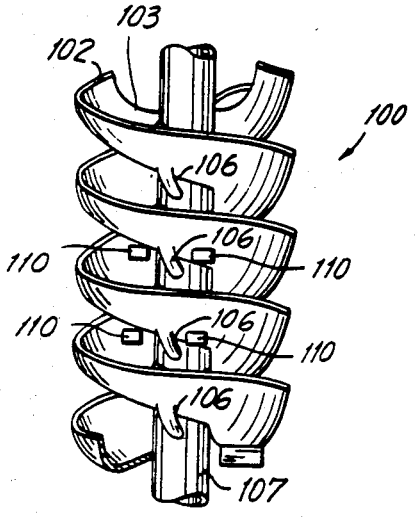
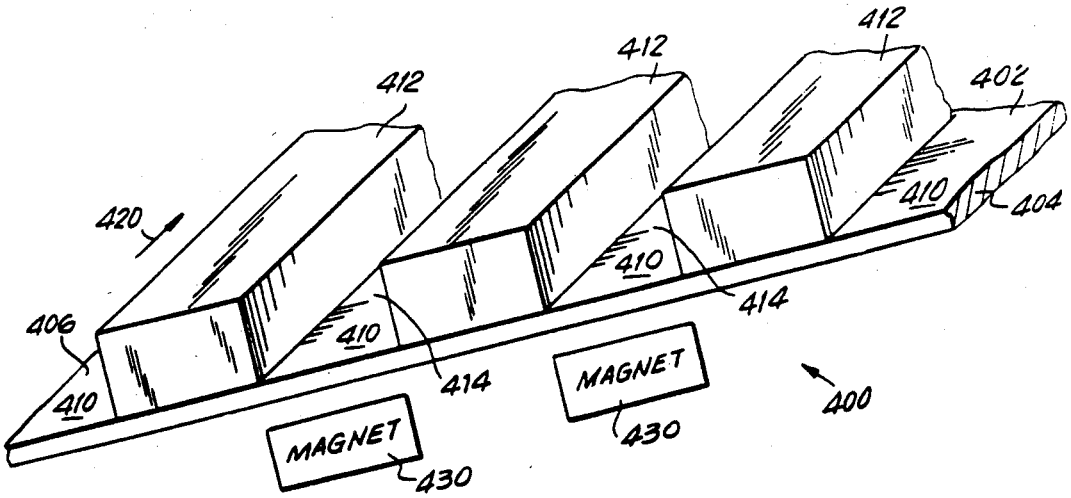
FIG.6

GRAVITY-MAGNETIC ORE SEPARATORS AND METHODS

This is a division of U.S. application Ser. No. 482,040, filed Apr. 4, 1983, now U.S. Pat. No. 4,565,624.

TECHNICAL FIELD

This invention relates to apparatus, and methods for separating magnetic or weakly magnetic minerals from feed materials such as ores, beach sands and gravels and more particularly, for enhancing the separating capability of conventional gravity separators through the addition of magnetic forces which are substantially codirectional with the gravity force.

BACKGROUND ART

In conventional gravity separators, differences in the specific gravities of the different individual minerals or phases making up the mixture known as the feed material are used to accomplish the separation. Generally, a stream of the feed material flows over a downward sloping surface under the influence of the force of gravity. Typically, the surface is an inclined plane or cone, or spiral. The higher specific gravity particles, which generally become the concentrate (e.g. wolframite, magnetite, tin, gold), tend to settle near the bottom of the stream of feed material, while the lower specific gravity particles, which generally become the tailings, tend to congregate near the top of the stream. Alternatively, in particular applications, it is the particles which congregate near the top of the stream which are saved while the particles which settle near the bottom are discarded. Various means, some of which are described below, are used to divide the top of the stream from the bottom of the stream so as to separate the tailing and concentrate.

In practice, many minerals such as wolframite, a source of tungsten, are magnetic or weakly magnetic and have a high specific gravity. Wolframite is usually separated from its ore in two distinct stages, the first stage being gravity separation and the second stage being magnetic separation. More particularly, the first stage typically involves wet gravity separation of ground wolframite ore using one of the conventional gravity separators e.g. cones, spirals, shaking tables, pinched sluices, etc. The wet gravity concentrate is then dried and subjected to dry magnetic separation to produce a tungsten concentrate. Such dry magnetic separation may be accomplished with the magnetic and gravity forces working against or opposite one another.

The performance of a conventional gravity separator in separating high specific gravity magnetic or weakly magnetic minerals from their ores can be improved by combining the gravity force with codirectionally acting magnetic forces. The reason for this is that the resultant of the gravity and magnetic forces is more effective in causing high specific gravity magnetic or weakly magnetic particles to settle at the bottom of a stream of feed material than is the gravity force acting alone. One resulting advantage is the recovery of relatively fine-sized magnetic or weakly magnetic particles which are often difficult to recover using a conventional gravity separator. While not eliminating the need for the separate magnetic separation stage in the above described process for recovering wolframite, adding magnetic forces to a conventional gravity separator improves both the capacity of the gravity separator and the grade of concentrate produced by the gravity separator.

An ore separator in which substantially codirectional magnetic and gravitational forces are used to concentrate magnetic or weakly magnetic minerals is disclosed in Martinez, "The Concentration of Weakly Magnetic Minerals", The Pennsylvania State College Department of Mineral Engineering, Masters Thesis, 1953, a lone copy of which was deposited in the library of Pennsylvania State College. In this separator, a plurality of stationary permanent magnets is located beneath and along the length of an inclined planar surface which is formed by the uphill moving portion of a continuously moving endless belt. Wet ore is fed onto the belt and tends to move downhill. However, the magnetic or weakly magnetic particles in the ore are attracted by the magnets located beneath the moving belt and are moved uphill by the moving belt. In this ore separator, the tailing is collected at the bottom of the incline and the concentrate is collected near the top of the incline. The belt is used so as to continuously move the magnetic or weakly magnetic particles away from the magnets to which they are attracted. If this is not done, the magnetic or weakly magnetic particles will build up on the separator surface at sites corresponding to the locations of the magnets and will in time upset the concentration process by selectively blocking flow of the wet ore, thereby creating undesirable eddy currents. In addition, the build up of magnetic or weakly magnetic particles on the separator surface may ultimately distort or shield the magnetic field. In addition to including the desired magnetic or weakly magnetic particles, the unwanted build up may also include other types of magnetic or weakly magnetic parti- cles.

The processing of most ores containing desirable magnetic or weakly magnetic minerals requires crushing and grinding of the feed material to a fine size. Crushing and grinding introduces into the ore mill iron, abraded from the crusher, grinding mill liners, rods, and balls. This material is highly magnetic. In addition, many ores containing desirable magnetic or weakly magnetic minerals also contain magnetic or weakly magnetic minerals, such as pyrrhotite (FeS), which may be considered gangue or worthless material. The mill iron, as well as the worthless magnetic and weakly magnetic minerals will be attracted by the magnetic field and will, if a means is not used to allow them to be removed from the separator surface, build up near the magnets. An alternative solution to the problem of build up of magnetic particles is disclosed in Japanese Pat. No. 143967. The Japanese patent discloses a separator in which a slurry of coal and iron ore flows along the bottom of a separation tank while the slurry is agitated by water coming from sprinklers. The iron ore sticks to the bottom of the tank which is magnetized by electromagnetic coils while the non-magnetic materials are washed away. Scrapers are used to remove the built up iron ore from the tank bottom.

While the above described gravity-magnetic ore separators may, under certain circumstances, exhibit improved concentration capability for magnetic or weakly magnetic minerals, no means has heretofore been disclosed for providing conventional gravity separators such as Wright concentrators, cones, pinched sluices, spirals, shaking tables, etc. with magnetic forces so as to improve the ore concentrating capabilities of such standard gravity separators. One reason for this is that no adequate solution to the problem of preventing build up of magnetic materials on the flow surface of a conventional gravity separator equipped with magnetic force applying means has heretofore been proposed. Accordingly, it is an object of the present invention to provide means for modifying conventional already existing gravity separators with magnetic force applying means so as to improve their ore concentrating capabilities while at the same time inhibiting the build of magnetic materials.

DISCLOSURE OF THE INVENTION

The present invention is an apparatus for separating magnetic or weakly magnetic minerals from feed materials such as ores through the use of codirectional magnetic and gravity forces. The inventive apparatus is particularly useful for weakly magnetic minerals, such as ilmenite and wolframite. Preferably, the inventive separating apparatus comprises: a generally downward sloping surface over which the feed material flows under the influence of gravity; magnet means for applying a magnetic force which is codirectional with the gravity force to the feed material while the source material flows over the surface; and means for varying the magnetic force for preventing the build up of the magnetic or weakly magnetic minerals on the surface.

In a typical embodiment of the invention, the surface is the surface over which the ore flows in a conventional gravity separator such as a Wright concentrator, spiral, cone, pinched sluice, or shaking table. The magnet means illustratively comprises permanent magnets which are mounted beneath the surface on rotatable sheets, rotatable wheels, movable endless belts or other means for varying the position of the magnets relative to the surface so as to vary the magnetic force and prevent buildup of magnetic particles on the surface. Alternatively, shields may be intermittently interposed between the surface and the magnets to vary the magnetic forces at particular locations on the surface. In addition, the magnetic force applying means, may comprise standard electromagnets in which case a conventional control circuit is used to intermittently vary or turn off the magnetic force to prevent build up of magnetic or weakly magnetic particles on the flow surface.

It should be noted that the present invention in its preferred form involves more than merely combining conventional magnets with conventional gravity separators to increase the downward acting force on high specific gravity magnetic or weakly magnetic particles in the feed material. Such a combination without more will in many instances not entirely achieve the desired result because magnetic particles will build up on the flow surface of the conventional gravity separator.

This build up of magnetic particles will ultimately shield the magnetic forces, disrupt the flow of the feed material, and interfere with optimum conditions for gravity separation. Accordingly, it is generally desired in the practice of the present invention that means for varying the magnetic force to prevent build up of magnetic material on the flow surface of the separator be included. Inventive units formed for example, by mounting magnets on wheels, belts, or movable sheets are used to provide time varying magnetic forces.

Modification of existing gravitational separators in accordance with the present invention results in numerous advantages in the processing of feed materials, such as ores, to yield particular magnetic or weakly magnetic minerals. When modified in accordance with the present invention, a conventional gravity separator exhibits increased feed rate capacity, increased ratio of concentration (weight of the feed material divided by weight of concentrate), and increased recovery of fine magnetic and weakly magnetic particles now lost in a conventional gravity separator. In certain cases, a distinct magnetic separation step which follows a conventional gravity separation step may be eliminated and in addition in conventional multistage gravitational separators, fewer stages would be needed to recover the desired grade of concentrate. As previously indicated, all of these advantages may be achieved without the deleterious build up of magnetic material on the flow surface of the conventional gravity separator.

BRIEF DESCRIPTION OF THE DRAWINGS

FIG. 4 is a view partly in perspective and partly in section illustrating a conventional spiral separator modified with magnet means in accordance with the principles of the present invention;

FIG. 6 diagrammatically illustrates in perspective a portion of a conventional shaking table separator which has been modified with magnetic means in accordance with an illustrative embodiment of the invention.

BEST MODE FOR CARRYING OUT THE INVENTION

The following is a description of several conventional gravity separators which have been modified through the use of magnets in accordance with the principles of the present invention.

A. Wright Concentrator

Figure 1:
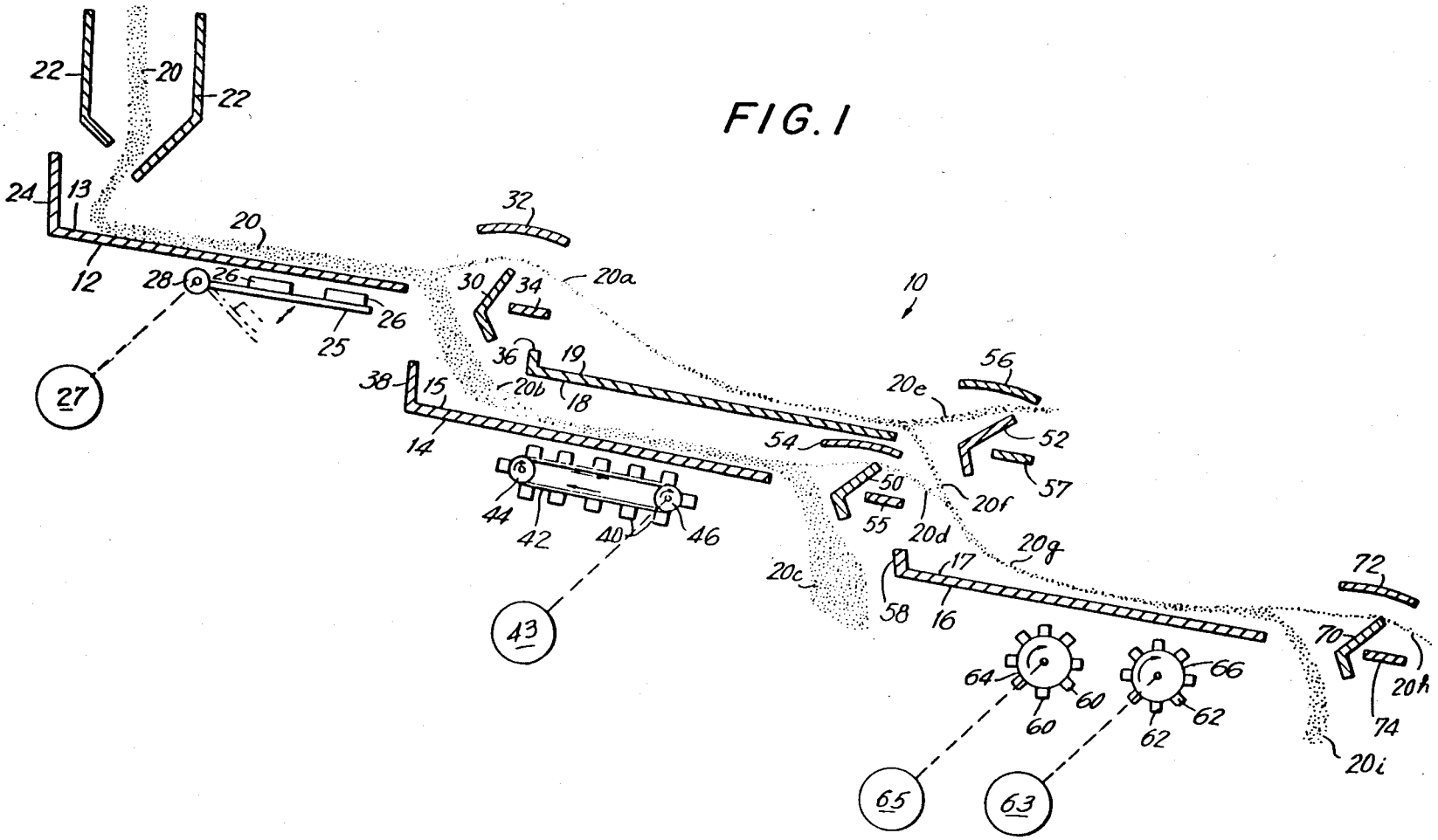
FIG. 1 is a partly diagrammatic and partly in section illustration of a conventional Wright Concentrator modified with magnet means in accordance with the principles of the present invention.

FIG. 1 illustrates a multistage Wright gravity concentrator 10 modified through the use of time varying magnetic forces to increase concentration capability. The Wright Concentrator comprises a plurality of concentration plates 12, 14, 16, 18. A feed stream of a wet feed material 20 which includes one or more magnetic or weakly magnetic minerals is fed onto the surface 13 of the plate 12 from feed unit 22. Particle guiding panel 24 which forms an approximately right angle with the plate 12 serves to guide the feed stream 20 onto the plate 12. Below the plate 12, mounted on a support such as a sheet 25 is a magnet means, here shown as a plurality of magnets, such as permanent magnets 26. As the feed stream 20 flows over the plate 12, the downward acting gravity force and the downward acting magnetic force produced by the magnets 26 cause the high specific gravity magnetic or weakly magnetic particles to settle near the bottom of the feed stream 20 while the nonmagnetic low specific gravity particles congregate near the top of the feed stream 20.

To prevent build up of magnetic particles on the surface 13, the sheet 25 is intermittently pivotted about axle 28 by a motor means 27 away from the plate 12 to vary the magnetic force in order to free any built up magnetic material. Of course, instead of permanent magnets mounted on a rotatable sheet, any other of the permanent or electromagnet arrangements described herein may be used to provide the time varying magnetic forces.

The application of the magnetic and gravity forces will tend to stratify stream 20 into an ore rich lower zone and a tailing rich upper zone. After the feed stream 20 flows to the end of the plate 12, baffle 30 divides the stream 20 into streams 20*a* and 20*b*. Stream 20*a* comprises the predominantly low specific gravity non-magnetic particles, while the stream 20*b* comprises the predominantly high specific gravity magnetic or weakly magnetic particles. Baffle 30 along with guiding panels 32, 34 and 36 serve to guide stream 20*a* onto surface 19 of plate 18 although magnet means could be positioned below the plate 18. Similarly, baffle 30 along with guiding panel 38 guides stream 20*b* onto surface 15 of plate 14.

In the embodiment of the Wright concentrator shown in FIG. 1, stream 20*a* after separation from stream 20*b* undergoes only gravity separation while flowing over the plate 18. Stream 20*b*, however, undergoes both gravity and magnetic separation while flowing over the plate 14. Magnetic forces are applied to stream 20*b* through the use of the permanent magnets 40 which are mounted on the endless belt 42. Pulleys 44 and 46 are used to cause the endless belt to move in the clockwise direction to prevent build up of magnetic material on surface 15, at least one of the pulleys being driven by a motor means 43. The endless belt 42 is moved by motor means 43 in the clockwise direction in order to ease the transport of the magnetic particles along the surface 15.

The application of gravity and magnetic forces to stream 20*b* stratifies that stream, in the manner in which stream 20 was stratified. Baffle 50 serves to separate stratified feed stream 20*b* into two streams 20*c* and 20*d*. Stream 20*c* is the concentrate which comprises largely high specific gravity magnetic or weakly magnetic particles. Note this concentrate (stream 20*c*) has been formed as a result of two gravity-magnetic separation stages taking place at plates 12 and 14. At this point it passes to a suitable collector (not shown). Similarly, baffle 52 divides stream 20*a* into streams 20*e* and 20*f*. Guiding panels 54, 55, 58 along with baffles 50 and 52 serve to direct streams 20*d* and 20*f* onto surface 17 of plate 16 where they combine to form stream 20*g*. Baffle 52 along with guiding panels 56 and 57 serve to direct stream 20*e* which comprises tailing out of the concentrator apparatus.

Stream 20*g* undergoes a third stage of gravity-magnetic magnetic separation. In this stage, the downward magnetic force results from two groups of permanent magnets 60 and 62. The magnets 60 are mounted on wheel 64 and the magnets 62 are mounted on wheel 66. Wheels 64 and 66 are rotated in the clockwise direction by motor means 65 and 63 respectively to prevent the build up of magnetic materials on surface 17 and to ease the transport of the magnetic materials along surface 17. The combined gravity and magnetic forces cause any high specific gravity magnetic or weakly magnetic particles remaining in the stream 20*g* to settle near the bottom of steam 20*g* while lighter, non-magnetic particles congregate near the top of the stream 20*g*. Thus, when baffle 70 divides the stream 20*g* into streams 20*h* and 20*i*, steam 20*i* becomes the middling, that is material which has a lower concentration of high specific gravity magnetic particles than the concentrate, but a higher concentration of such particles than the tailing. Stream 20*h* becomes a portion of the tailing and is guided out of the Wright Concentrator by panels 72 and 74 as well as baffle 70.

Figure 2:
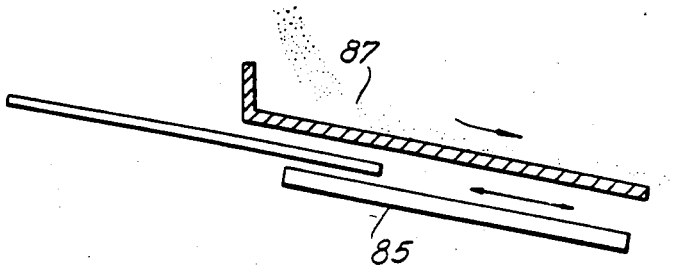
FIG. 2 is a partly diagrammatic and partly in section illustration of a concentration plate modified with magnets and shielding means in accordance with an illustrative embodiment of the invention.
Figure 3:
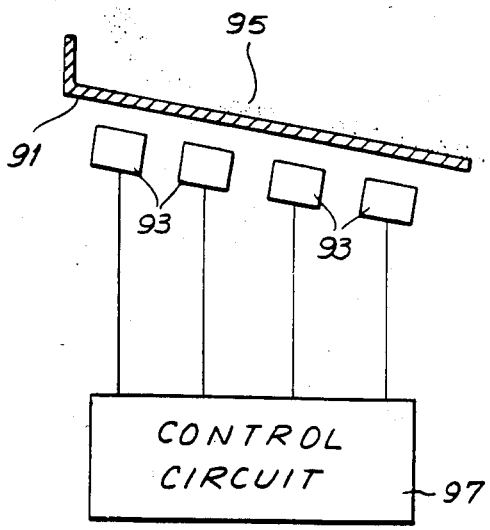
FIG. 3 is a partly diagrammatic and partly in section illustration of a concentration plate modified with electromagnets in accordance with an illustrative embodiment of the invention.

In FIG. 1, three means for providing varying magnetic forces are illustrated. These are permanent magnets mounted on a rotatable sheet, permanent magnets mounted on an endless belt, and permanent magnets mounted on rotatable wheels. All of these arrangements are designed to cause magnetic forces to act on the stream of source material while at the same time preventing a build up of magnetic material on the concentration plates. Numerous other arrangements may be used to achieve these objectives. For example, permanent magnets may be mounted on sheets which can be raised or lowered toward or away from the concentrator surfaces. Alternatively, the magnets may be permanently mounted and shields may be intermittently inserted between the magnets and the concentrator surfaces to prevent build up of magnetic material on the concentrator surfaces. For example, FIG. 2 shows a concentration plate 83 of the type discussed above equipped with diagrammatically illustrated magnet means 85 for applying magnetic forces to feed material 87 as the feed material flows over the plate 83. Shield 89 is intermittently positioned between the plate 83 and the magnet means 85 to vary the magnetic force on the source material, thereby preventing the build up of magnetic material on plate 83. Finally, conventional electromagnets may be used, in which case a conventional control circuit is utilized to periodically turn off or vary the magnetic field to prevent unwanted build up of magnetic material. For example, FIG. 3 shows a concentration plate 91 equipped with diagrammatically illustrated conventional electromagnets 93 for applying magnetic forces to feed material 95 as it flows over the plate 91. Typically, each of the magnets 93 comprises a current carrying coil surrounding a magnetic core. Diagrammatically illustrated conventional control circuit 97 is used to vary the current flowing in the electromagnets 93 so as to vary the magnetic forces and prevent build up of magnetic material on plate 91. In particular cases, all of the magnets 93 may be turned off at once or the magnets 93 may be turned off sequentially. It will be recognized that the three magnetic means 26, 40 and 60 employed in FIG. 1 are all differently mounted. Of course, in practice, they may all be the same, as may be preferable for sake of simplicity, or two may be of one type and one of the other. Some may be made of permanent magnets and others of electro magnets. The configuration shown in FIG. 1 and described above is just one of a large group of different possible arrangements.

II. Spiral Separator

Turning to FIG. 4, the separator 100 includes a spiral trough 102 of curved cross section. Feed material containing a high specific gravity magnetic or weakly magnetic mineral is introduced into the trough 102 near the top of the spiral. As the source material flows down the spiral trough 102 gravity separation takes place. Heavy material is removed through ports 106 spaced along the bottom 103 of the trough 102, that is near the center of the spiral 102. The highest grade of concentrate emanates from the ports at and near the top of the spiral, whereas the ports near the lower end of the spiral trough discharge middling. Materials discharged by the ports 106 enter a circular cylindrical pipe 107 which runs down the center of the spiral. The tailing flows out of the lower end of the spiral trough 102.

In order to improve the mineral concentrating capabilities of the spiral separator 100, means 110 for producing a varying magnetic force may be positioned beneath the spiral trough 102 at various locations along the spiral. In FIG. 2, four such means 110 for producing a time varying magnetic force are diagrammatically illustrated only. However understood that any of the means for producing a varying magnetic force described above in connection with the Wright concentrator (FIG. 1) are suitable for use in connection with the spiral. These means include permanent magnets suitably mounted on rotatable sheets, continuous belts, or rotatable wheels for varying the position of the magnets relative to the spiral to prevent the buildup of magnetic particles on the surface of the spiral. Alternatively, conventional electromagnets in conjunction with a conventional control circuit may be used to produce the varying magnetic forces. In or to have a significant effect on the separation of magnetic and weakly magnetic particles from the feed material, it is desirable that the means 110 be positioned underneath the bottom portion 103 of the trough 102 near the pipe 107 as most of the feed material flows over the bottom portion 103 of the trough 102. In addition, it should be noted that although only four means 110 for producing a time varying magnetic force are shown in FIG. 4, in particular embodiments of the invention means for producing a time varying magnetic force may be located adjacent one another along the spiral trough 102 so that feed material flowing down the spiral trough 102 is under the influence of time varying magnetic forces along most of the length of the spiral trough 102.

It should be noted that many of the spirals currently in use are made of iron or fiberglass reinforced plastic. In the case of the iron spirals, it may be necessary to replace sections of the spiral lying directly over the magnet means with a non-magnetic material such as fiberglass reinforced plastic, as iron will shield the source material from the magnetic forces.

III. Cones and Pinched Sluices

In addition to Wright concentrators and spirals, another conventional gravity separator which may be modified with magnets to improve its concentration capability is the cone. While the discussion hereinafter refers only to cones, it should be noted that this discussion is applicable to pinched sluices as well. With pinched sluices the magnets may be placed on the sides as well as underneath the separating surface.

Figure 5:
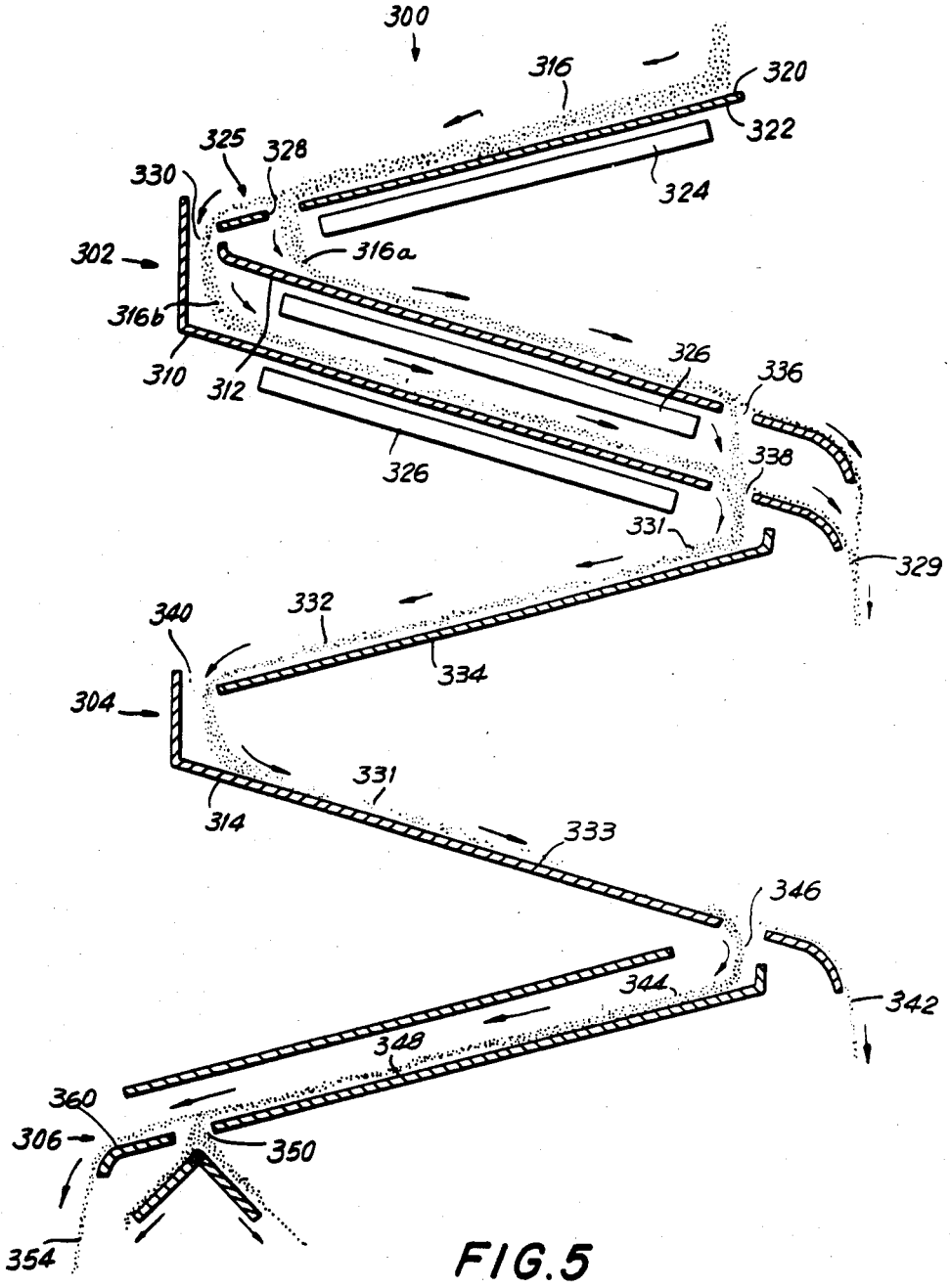
FIG. 5 diagrammatically illustrates a cross sectional view of a conventional cone type separator modified with magnet means in accordance with the principles of the present invention.

Turning to FIG. 5, separator 300 comprises three separator stages 302, 304, 306, stage 302 being a double cone concentrator, stage 304 being a single cone concentrator, and stage 306 being a tray concentrator. The double cone stage 302 comprises two cones 310 and 312 while the single cone stage 304 comprises only a single cone 314. In order to enter the cones 310 and 312, the feed material 316 flows over surface 320 of feed distributor 322. While the feed 316 flows over the surface 320, gravity separation takes place. In order to enhance the separation of magnetic and weakly magnetic particles from the feed 316, means 324 for producing time varying downward acting magnetic forces is mounted below the feed distributor 322. The magnetic forces should be varied to prevent buildup of magnetic material on surface 320.

In FIG. 5, the means 324 for applying time varying downward acting magnetic forces is diagrammatically illustrated only. These magnetic forces may be applied using conventional electromagnets or permanent magnets. As previously indicated, in the case of electromagnets, the magnetic force is varied through use of a conventional control circuit which intermittently varies the current flowing in the coils comprising the electromagnets. In the case of permanent magnets, the magnetic force on the feed can be varied by continuously or intermittently moving the magnets or by intermittently shielding the magnets from the feed, as has already been described with other embodiments.

After flowing down the surface 320, annular splitter 325 enables part of the feed **316*a* to flow through annular orifice 328 into upper cone 312 of separator stage 302 and the remainder of the feed 316*b* to flow past orifice 328 and through annular orifice 330 into lower cone 310 of separator stage 302. Source material 316*a* contains a higher concentration of high specific gravity magnetic or weakly magnetic particles than does source material 316*b* as a result of separation which took place while the feed was flowing over surface 320**.

While source materials **316*a* and 316*b* flow down the inner surfaces of cones 312 and 310, respectively, further gravity and magnetic separation occurs. The downward acting time varying magnetic forces are applied by diagrammatically illustrated magnet means 326, of any of the forms previously shown and/or described. At the bottom of cones 310 and 312, the light weight tailing 329 is removed while the concentrate 331 enters onto the outer surface 332 of distributor 334 through annular openings 336 and 338. The concentrate 331 flows down surface 332 and enters cone 314 via annular opening 340. Gravity separation takes place while the concentrate material 331, resulting from separation stage 302, flows down surface 332 and surface 333 which is the inner surface of cone 314. Middlings 342 is removed at the bottom of cone 314 while concentrate 344 resulting from the second separation stage 304 enters tray concentrator 306 through passageway 346. As concentrate 344 flows down surface 348 of tray concentrator 306 further gravity separation takes place. Concentrate 350 from the separation stage 306 is collected at orifice 352 while the middlings 354 is removed from the tray concentrator at the end 360 of surface 348. It should be noted that while stages 304 and 306** use only gravity separation they could be modified in accordance with the principles of the present invention so that both gravity and magnetic separation are utilized with either one or both of them.

IV. Shaking Table

Turning to FIG. 6, shaking table 400 comprises a generally rectangular deck 402 which slopes gradually downward from the feed end 404 to the tailing end 406. Extending longitudinally along the upper surface 410 of the deck is a plurality of spaced apart riffles 412 which serve to form a plurality of troughs 414. The deck 410 is able to undergo reciprocating motion in a direction parallel to the longitudinally extending riffles.

Source material containing a high specific gravity magnetic or weakly magnetic mineral flows downward over the surface 410 of the deck 402 from the feed end 404 to the tailing end 406. The fundamental principle of operation of the shaking table is vertical stratification according to specific gravity. That is, high specific gravity particles are generally trapped behind the riffles whereas low specific gravity particles are able to flow over the riffles and are removed at the tailing end. It should be noted, however, that very fine particles of heavy material may not be trapped between the riffles of conventional shaking tables and may be lost.

The particles trapped between the riffles are removed as a result of the longitudinal reciprocation of the deck 402. Roughly what happens is that the deck 402 is moved slowly in the direction of arrow 420 and then snapped backwards relatively fast. The inertia of the particles trapped between the riffles causes them to continue moving in the direction of arrow 420 when the deck 402 is snapped backward. Eventually the particles trapped behind the riffles come to the end of the deck where they are removed as concentrate.

Diagrammatically illustrated means 430 for producing a varying magnetic force are placed under the table surface and troughs 414 in order to trap magnetic and weakly magnetic particles in the troughs 414 formed by the riffles 412. Use of the magnetic force in addition to the gravity force enables the trapping of particles which would be lost if a conventional shaking table were used. Varying the magnetic force can be accomplished with permanent or electromagnets in the manners previously described. As is true with the other embodiments varying the magnetic field prevents the buildup of magnetic particles on the surface 410 deck 402 of the shaking table 400. In a possible alternative embodiment of the invention, the riffles themselves might be formed from magnetic material to enhance the trapping of magnetic and weakly magnetic particles.

Finally, it is to be understood that the above-described embodiments of the invention are intended to be illustrative only and that numerous alternative embodiments of the invention may be constructed by those skilled in the art without departing from the scope and spirit of the claims which follow.

What is claimed is:

1. An apparatus for separating magnetic or weakly magnetic material from non-magnetic material having a lower specific gravity than said magnetic or weakly magnetic material, said magnetic or weakly magnetic material and said non-magnetic material being combined in a mixture with a non-magnetic liquid, said apparatus being effective for separating magnetic or weakly magnetic particles, said apparatus comprising:

a generally planar surface having a feed end and a tailing end, said surface sloping downward from said feed end to said tailing end with said mixture flowing over said surface from said feed end to said tailing end;

a plurality of riffles extending along said surface and forming a plurality of troughs for trapping said high specific gravity material for effecting at least a partial gravity separation of said high specific gravity magnetic or weakly magnetic material from said non-magnetic material as said mixture flows over said surface;

means for applying a magnetic force beneath said surface for augmenting said gravity separation with magnetic separation by attracting said magnetic or weakly magnetic material toward said surface for further aiding said particles to become trapped within said troughs, there being no other forces applied to said magnetic or weakly magnetic material in opposition to said magnetic and gravity forces;

means for intermittently reducing said magnetic force to prevent the buildup of said magnetic or weakly magnetic material on said surface by permitting motion of said magnetic or weakly magnetic material;

means for reciprocating said surface generally parallel to said riffles for discharging said trapped magnetic or weakly magnetic material from said troughs, the lower specific gravity non-magnetic material flowing over said riffles for discharge at a location remote from the discharge of said magnetic or weakly magnetic material.

2. The apparatus of claim 1, wherein said magnetic force applying means comprises one or more electromagnets and said magnetic force reducing means comprises a control circuit.

3. The apparatus of claim 1, wherein said magnetic force applying means comprises one or more permanent magnets and said magnetic force reducing means comprises means for varying the position of said one or more permanent magnets relative to said surface.

4. The apparatus of claim 1, wherein said magnetic force applying means comprises one or more magnets and said magnetic force reducing means comprises shielding means intermittently inserted between said magnets and said surface.

5. A method for separating magnetic or weakly magnetic material from a mixture including non-magnetic material having a lower specific gravity than said magnetic or weakly magnetic material, said method being effective for separating magnetic or weakly magnetic particles, the method comprising:

forming a mixture by combining said magnetic or weakly magnetic material and said non-magnetic material with a non-magnetic liquid;

feeding said mixture onto a generally planar surface having a plurality of troughs extending therealong, said generally planar surface having a feed end raised relative to a tailing end thereof, said mixture being fed onto said feed end and flowing over said surface from said feed end to said tailing end for achieving at least a partial gravity separation between said magnetic or weakly magnetic material and said non-magnetic material by trapping said magnetic or weakly magnetic material in said troughs as said material flows downwardly over said surface under the influence of the force of gravity;

applying a magnetic force beneath said surface while said mixture flows thereover for augmenting said gravity separation of magnetic separation by attracting said magnetic or weakly magnetic material towards said surface, there being no other forces applied to said magnetic or weakly magnetic material in opposition to said magnetic and gravity forces;

intermittently reducing the magnetic force to prevent the buildup of said magnetic or weakly magnetic material on said surface by permitting motion of said magnetic or weakly magnetic material in said troughs; and reciprocating said surface generally parallel to said riffles for moving said trapped magnetic or weakly magnetic material in said troughs for eventual discharge therefrom for effecting a separation of said higher specific gravity magnetic or weakly magnetic material from said lower specific gravity non-magnetic material.

6. An apparatus for separating magnetic or weakly magnetic material from non-magnetic material having a lower specific gravity than said magnetic or weakly magnetic material, said magnetic or weakly magnetic material and said non-magnetic material being combined in a mixture with a non-magnetic liquid, said apparatus being effective for separating magnetic or weakly magnetic particles, said apparatus comprising:

a spiral-shaped surface over which said mixture flows under the influence of the force of gravity for achieving at least a partial gravity separation of said magnetic or weakly magnetic material from said non-magnetic material as said mixture flows downwardly over said surface under the influence of gravity;

means for applying a magnetic force beneath said surface for augmenting said gravity separation with magnetic separation by attracting said magnetic or weakly magnetic material toward said surface, there being no other forces applied to said magnetic or weakly magnetic material in opposition to said magnetic and gravity forces;

means for intermittently reducing said magnetic force to prevent the buildup of said magnetic or weakly magnetic material on said surface by permitting downward motion of said magnetic or weakly magnetic material; and, means for separating the higher specific gravity non-magnetic or weakly magnetic material comprising a portion of the material adjacent said surface from the lower specific gravity non-magnetic material comprising a portion of the material riding above said material adjacent said surface.

7. The apparatus of claim 6, wherein said magnetic force applying means comprises one or more electromagnets and said magnetic force reducing means comprises a control circuit.

8. The apparatus of claim 6, wherein said magnetic force applying means comprises one or more permanent magnets and said magnetic force reducing means comprises means for varying the position of said one or more permanent magnets relative to said surface.

9. The apparatus of claim 6, wherein said magnetic force applying means comprises one or more magnets and said magnetic force reducing means comprises shielding means intermittently inserted between said magnets and said surface.

10. A method for separating magnetic or weakly magnetic material from a non-magnetic material having a lower specific gravity than said magnetic or weakly magnetic material, said method being effective for separating magnetic or weakly magnetic particles, the method comprising:

forming a mixture by combining said magnetic or weakly magnetic material and said non-magnetic material with a non-magnetic liquid;

feeding said mixture onto the raised end of a downwardly sloping spiral-shaped surface of sufficient length to achieve at least partial gravity separation between said magnetic or weakly magnetic material and said non-magnetic material as said mixture flows over said surface under the influence of the force of gravity;

applying a magnetic force beneath said spiral surface while said mixture flows thereover for augmenting said gravity separation by magnetic separation by attracting said magnetic or weakly magnetic material toward said surface, there being no other forces applied to said magnetic or weakly magnetic material in opposition to said magnetic and gravity forces;

intermittently reducing the magnetic force to prevent the buildup of said magnetic or weakly magnetic material on said surface by permitting downward motion of said magnetic or weakly magnetic material; and separating the higher specific gravity magnetic or weakly magnetic material comprising a portion of the material adjacent said surface from the lower specific gravity non-magnetic material comprising a portion of the material riding above said material adjacent said surface.

* * * * *